US012660958B2

(12) United States Patent
Bing et al.

(10) Patent No.: US 12,660,958 B2
(45) Date of Patent: Jun. 23, 2026

(54) SEPARABLE HOSPITAL CURTAIN

(71) Applicant: Cintas Corporate Services, Inc., Cincinnati, OH (US)

(72) Inventors: Richard R. Bing, West Chester, OH (US); Bryan J. Colpo, Cincinnati, OH (US); Shawn K. King, Mason, OH (US); David Steven Mesko, Wyoming, OH (US); Amy E. Wilker, Bellevue, KY (US); Michael Komatz, New York, NY (US); Adem Önalan, Istanbul (TR); Marco Perry, Brooklyn, NY (US); Brooke Williams, New York, NY (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 239 days.

(21) Appl. No.: 17/982,586

(22) Filed: Nov. 8, 2022

(65) Prior Publication Data

US 2023/0148778 A1 May 18, 2023

Related U.S. Application Data

(60) Provisional application No. 63/320,366, filed on Mar. 16, 2022, provisional application No. 63/320,369, (Continued)

(51) Int. Cl.
*A47H 23/04* (2006.01)
*A47H 1/04* (2006.01)
(Continued)

(52) U.S. Cl.
CPC ..... *A47H 23/04* (2013.01); *A47H 1/04* (2013.01); *A47H 13/00* (2013.01); *A47H 23/02* (2013.01);
(Continued)

(58) Field of Classification Search
CPC ..... A47H 2201/00; A47H 23/04; A47H 2001/045; A47H 23/00; A47H 23/08;
(Continued)

(56) References Cited

U.S. PATENT DOCUMENTS 588,454 A 8/1897 Lloyd
708,381 A 9/1902 Miller
(Continued)

*Primary Examiner* — Abe Massad
*Assistant Examiner* — Matthew R. Shepherd
(74) *Attorney, Agent, or Firm* — FBT Gibbons LLP

(57) ABSTRACT

A curtain is suitable for use in a hospital or patient facilities or in surgical settings. The curtain includes a bottom panel removably attached and suspended from a top panel. The top panel may be suspended from a rail by suspension means such as hooks or rings. The top panel may be a mesh so as to allow air, light, and/or water to pass through. The bottom panel may be opaque to provide privacy. The bottom panel may be single-use or disposable, or may be reusable. The top and bottom panels are joined by a zipper to allow for removal of the bottom panel for washing or replacement. The zipper track has curved portions to allow for easier access to begin the zipping and unzipping process. The curved portions orient the zipper out of the plane of the curtain to allow for easier movement of zipper through the curved portions.

10 Claims, 9 Drawing Sheets

Related U.S. Application Data filed on Mar. 16, 2022, provisional application No. 63/317,112, filed on Mar. 7, 2022, provisional application No. 63/304,833, filed on Jan. 31, 2022, provisional application No. 63/280,651, filed on Nov. 18, 2021.

(51) Int. Cl.
*A47H 13/00* (2006.01)
*A47H 23/02* (2006.01)

(52) U.S. Cl.
CPC .... *A47H 2001/045* (2013.01); *A47H 2201/00* (2013.01)

(58) Field of Classification Search
CPC .. A47H 2023/025; A47H 23/10; A47H 23/02; A47H 23/06; A47K 3/38
See application file for complete search history.

(56) References Cited

U.S. PATENT DOCUMENTS 1,413,846 A 4/1922 Fredak
1,447,149 A 2/1923 Pfeiffer
1,809,109 A 6/1931 Clark et al.
2,273,426 A 2/1942 Washburn
2,375,457 A 5/1945 Woodward
2,654,486 A 10/1953 Lundkvist
3,120,895 A 2/1964 Mahana et al.
3,416,672 A 12/1968 Kohaut
3,777,314 A * 12/1973 Boser ..... A41H 37/003 2/265
3,968,523 A * 7/1976 Newman ..... A41D 27/202 2/265
4,606,527 A 8/1986 Ziller et al.
4,693,291 A 9/1987 Andrews
4,996,933 A * 3/1991 Boser ..... D05B 35/064 112/152
5,217,057 A 6/1993 Hubbard et al.
5,240,758 A * 8/1993 Honigberg ..... A47K 3/38 5/493
5,410,975 A * 5/1995 Dudek ..... D05B 35/064 112/113
6,192,965 B1 * 2/2001 Hinds ..... A47K 3/38 160/DIG. 18
6,394,168 B1 5/2002 Zoboski
7,350,244 B1 4/2008 Handley
7,909,082 B2 3/2011 Peoples
8,464,365 B1 6/2013 Nunn et al.
8,500,188 B2 * 8/2013 Huotari ..... B60J 7/10 296/146.14
9,204,749 B1 * 12/2015 Trapani ..... A61G 12/00
9,661,947 B2 5/2017 Mayer
10,973,356 B2 4/2021 Choi
10,975,605 B2 4/2021 Hamilton et al.
11,944,227 B1 4/2024 Green et al.
2006/0026747 A1 2/2006 Prabhakar
2007/0261803 A1 11/2007 Alexander et al.
2007/0284058 A1 12/2007 Peoples
2012/0222826 A1 * 9/2012 Foss ..... D06M 11/83 160/237
2013/0205548 A1 * 8/2013 Wehner ..... D05B 35/064 112/475.16
2014/0209255 A1 7/2014 Degiovanni et al.
2019/0000240 A1 1/2019 Rabbany et al.
2022/0007872 A1 1/2022 Stern
2023/0148779 A1 * 5/2023 Bing ..... A47H 1/04 160/330
2023/0329470 A1 10/2023 Bing et al.
2023/0404298 A1 12/2023 Blase

* cited by examiner

SEPARABLE HOSPITAL CURTAIN

This claims the benefit of U.S. Provisional patent application Ser. No. 63/280,651, filed Nov. 18, 2021; Ser. No. 63/304,833, filed Jan. 31, 2022; Ser. No. 63/317,112, filed Mar. 7, 2022; Ser. No. 63/320,369, filed Mar. 16, 2022; and Ser. No. 63/320,366, filed Mar. 16, 2022, each of which is hereby incorporated by reference in its entirety.

BACKGROUND

This invention relates generally to curtains and, more specifically, the invention relates to a detachable, ventilating enclosure for use with a supporting structure or railing to provide an enclosure of the type utilized for hospital settings, surgical facilities, or the like.

Curtains are often used to divide larger hospital rooms into individual patient or examination areas. They are useful in providing a patient with his or her own private area when other patients are in the room or to provide privacy in higher traffic settings in a hospital, clinic or other healthcare facility, such as an emergency room or post-operative recovery room. Often, the curtains are attached by hooks or other means that are slidably mounted to curtain tracks attached to the ceiling of the hospital room or other healthcare facility. The slidable mounting makes it convenient for the curtains to be moved back and forth between open and closed positions so that a health care professional, visitor, or the patient may enter and exit the area with ease.

Typically, hospital curtains are made from cloth or a cloth-like material. Due to the fibrous nature of this type of material, the cubicle curtains often become a haven for bacteria and microbial growth. Bacteria and germs are transmitted to and from the curtains through the air or by physical contact, often by the hands of a health care provider or visitor who did not have an opportunity to wash his or her hands after examining the patient and before moving the curtain. Moreover, the process of installing a new or washed and cleaned curtain may result in the curtain contacting the floor and attracting contaminants and unwanted particles that might be present on the floor.

Such curtains in the prior art are expensive to manufacture, difficult to launder, and increase the risk of infection. One noted problem is that removal of prior curtains for cleaning often requires the individual removing the curtain to stand on a chair or similar piece of furniture to reach the top of the curtain and detach the curtain from the ceiling mounted rail or support mechanism. Replacement of a curtain has a similar problem. This can be dangerous to the individual doing the removing and any patient nearby. Use of a chair or ladder may be required to adequately access and remove/install the curtain. This can be potentially dangerous if the person falls from the chair of ladder and, at the least, is time consuming and cumbersome, especially if dozens of curtains are being removed and reinstalled at a time.

It is known in the art to make a bottom portion of the curtain separable from the top portion as shown in U.S. Pat. No. 9,204,749, which is hereby incorporated by reference in its entirety. In the invention disclosed in the '749 patent, the hospital curtain is made up of a ventilated top portion attached by curtain carriers and eyelets to a ceiling mounted curtain track, and a bottom portion joined to a bottom edge of the top portion by a zipper for selective removal of the bottom portion for washing or replacement. However, the zipper is often located at a height well above the floor of the room and is difficult for most service personnel to easily unzip or zip the bottom portion from/to the top portion without the benefit of a ladder, step stool or other device. One of the drawbacks to this type of design is that most zippers are designed for attaching two portions of material along a substantially straight section of each portion of the material.

A typical zipper has two interlocking tracks each made up of dozens of teeth, each of which combines a hook and a hollow. A closed zipper is one in which every hook on each of the two tracks is latched into a hollow on the opposite track. The latching mechanism, called the slide or hub, is just a collection of wedges. As the slide or hub moves along the zipper, the two teeth tracks must enter at a specific angle. As the tracks move through the slide, the slide's inclined edges push the teeth toward each other. The tracks are offset from each other, so each hollow settles onto a hook in sequence. For this to work properly, each tooth must be exactly the same size and shape, and they all must be perfectly positioned on the track.

In a well-made zipper, the interlocking teeth form an incredibly secure bond making it very difficult to separate the teeth by pulling the two strips apart. But the slide can easily separate the teeth, using a simple plow-shaped wedge. When the slide is pulled, the wedge pushes against the slanted edges of the hooks, pivoting each tooth off of the tooth below it. Just like that, the zipper tracks are unzipped and detached. If the zipper has a curved path, such as for use with a foldable curtain, the zipper is difficult to use. More specifically, when the zipper has a curved path and both sides of the zipper are in the same plane (i.e., the x-y plane of the curtain), the track of the zipper attached to the lower curtain has a shorter radius in relation to the track of the zipper attached to the upper curtain portion. This makes the zipper difficult to use around the corners because there is an imbalanced amount of stress placed on the track of the zipper connected to the lower portion than the track of the zipper connected to the upper portion. A typical zipper is designed for connecting two sheets of material along a substantially straight surface and a curved zipper path creates un-equal stresses on the mating teeth of the zipper and, as a result, difficulty in moving the zipper slide or hub along the zipper path. This imbalanced stress is increased, and the difficulty in moving the zipper slide increased, when the radius of the curve is smaller.

Accordingly, what is needed is an improved hospital curtain that can be easily and safely removed and replaced without the need for a ladder or other assisting device to remove and replace the curtain.

Furthermore, there exists a need for a zipper which is suitable for providing a selective connection between portions of the curtain having various curves.

The above and other objects and advantages in accordance with the principles of this invention shall be made apparent from the accompanying drawings and the description thereof.

SUMMARY OF THE INVENTION

This invention overcomes these and other shortcomings of the prior art by providing a hospital curtain having of a ventilated narrow top portion slideably attached along a ceiling track. A wide bottom portion of the curtain is removably attached to the narrow top portion by a zipper extending therebetween.

One feature of the hospital curtain according to various embodiments of this invention is a zipper or other attachment mechanism which joins the lower edge of the top panel to the upper edge of the bottom panel. Zippers are well known in the art for such an attachment mechanism, but the zipper according to various embodiments of this invention may have a contoured shape or curved portions to join the bottom edge of the top portion to the top edge of the bottom portion. The curved portions allow for the ends of the zipper tracks to extend downwardly for easier access to a user zipping the curtain portions together or unzipping them apart. The contour of the zipper includes relatively small radius curved portions to may make it easier for an installer who may not be able to reach the lower edge of the top panel for installation and/or removal of the bottom panel. The lateral ends of the zipper extend downwardly from the lower edge of the top panel for more convenient access when mating the zipper portions on the top and bottom panels together or unzipping them apart.

This invention is directed to a combination of a fastener or zipper for use with a curtain for a hospital room or clinical setting. The zipper also changes from being in a two-dimensional plane through linear portions of its path to a three-dimensional plane around a curved portion of the zipper joint, reducing the stress placed on the portion of the zipper connected to the bottom portion of the curtain. The zipper attachment device selectively connects the bottom and top portions of the curtain together. The zipper is disposed in a first plane in the areas of the straight portion of the zipper track, and the zipper is in a second plane not parallel to the first plane in the areas of the curved portion of the zipper track to reduce stress on the zipper components and allow for easier movement of zipper in tight radius corners.

The zipper includes a first seam connecting the first half of the zipper to the bottom portion of the curtain such that a portion of the first half is disposed in the first plane, and a portion of the first half is disposed in the second plane. The zipper also includes a second seam connecting the second half of the zipper to the top portion of the curtain such that a portion of the second half is disposed in the first plane, and a portion of the second half is disposed in the second plane. The change in position of the zipper between the first plane and the second plane reduces the amount of stress on the zipper in the curved portions of the zipper track.

An additional aspect of various embodiments of this invention is a zipper assist pole with a head feature designed to engage a zipper pull on the zipper and allow a user to pull the zipper pull across the joint between the top and bottom portions to zip them together or unzip them apart. The zipper assist pole allows a user to comfortably stand on the floor grasping the pole and engage the zipper pull with the zipper assist pole head to pull the zipper pull along the zipper track above head level.

The top panel may be solid, or include a mesh or mesh-like fabric or substance. The top panel may be constructed so as to allow air, light, and/or water to pass through. The bottom panel may be opaque so as to provide privacy, and may be manufactured from a variety of materials known to the industry, including but not limited to polypropylene, polyester, treated natural fibers, or other fabrics. The material may be flame resistant and/or antibacterial. The bottom panel may be single-use or disposable, or may be reusable. In one exemplary embodiment, the bottom panel is manufactured from sturdy material able to withstand frequent washings or cleanings. Once removed from the top panel, the bottom panel may be discarded or laundered and re-installed on the same or a different top panel. Once the bottom panel is removed from the top panel, a different and clean bottom panel may be installed onto the top panel.

Easy removal and replacement of the bottom panel for cleaning and other purposes is thereby promoted by embodiments of this invention. Once removed, the bottom panel may be cleaned and re-installed onto the top panel. Alternatively, a different, new and/or clean bottom panel may be installed on the top panel which may be part of a service providers role in the maintenance of the clinical setting and associated curtain installation.

Further areas of applicability of this invention will become apparent from the detailed description provided hereinafter. It should be understood that the detailed description and specific examples, while indicating embodiments of the invention, are intended for purposes of illustration only and are not intended to limit the scope of the invention.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
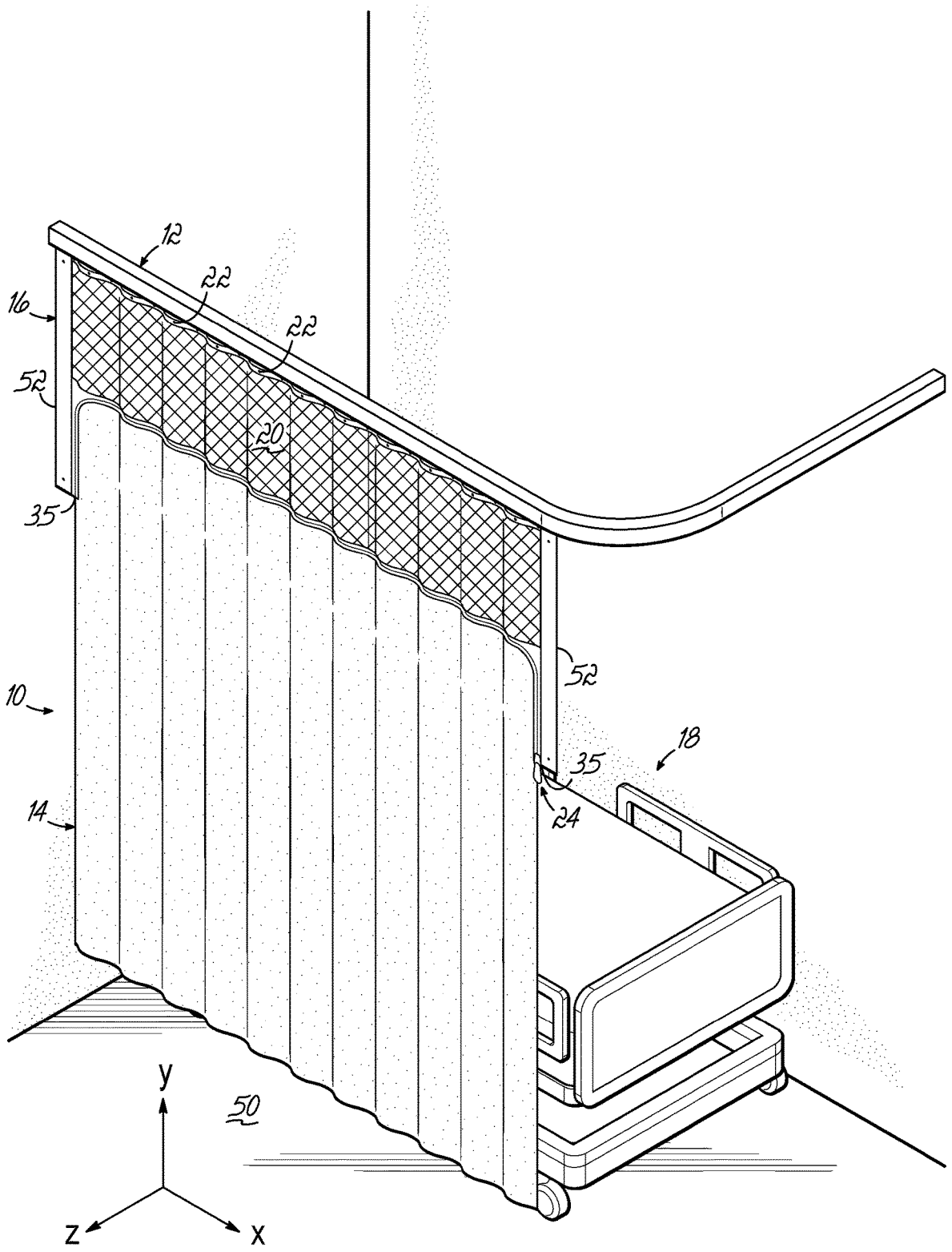
FIG. 1 is a perspective view of one embodiment of a separable curtain in a clinical setting according to this invention.

Turning now to the drawings, in which similar reference characters denote similar elements throughout the several views. With regard to the reference numerals used, the following numbering is used throughout the various drawing figures. The following discussion describes in detail at least one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of one embodiment of this invention being a curtain assembly 10 suspended from a track 12, showing a tall or wide bottom portion 14 separable from a short or narrow top portion 16. The bottom and top portions 14, 16 are joined along a juncture therebetween as shown in FIG. 1. The track 12 may be mounted to a ceiling atop an exam area 18 defined at least in part by the curtain assembly 10. The top and bottom portions 16, 14 are suspended from the track in a generally vertical orientation defining a common plane even though the portions 14, 16 may have various ripples or undulations.

Figure 2:
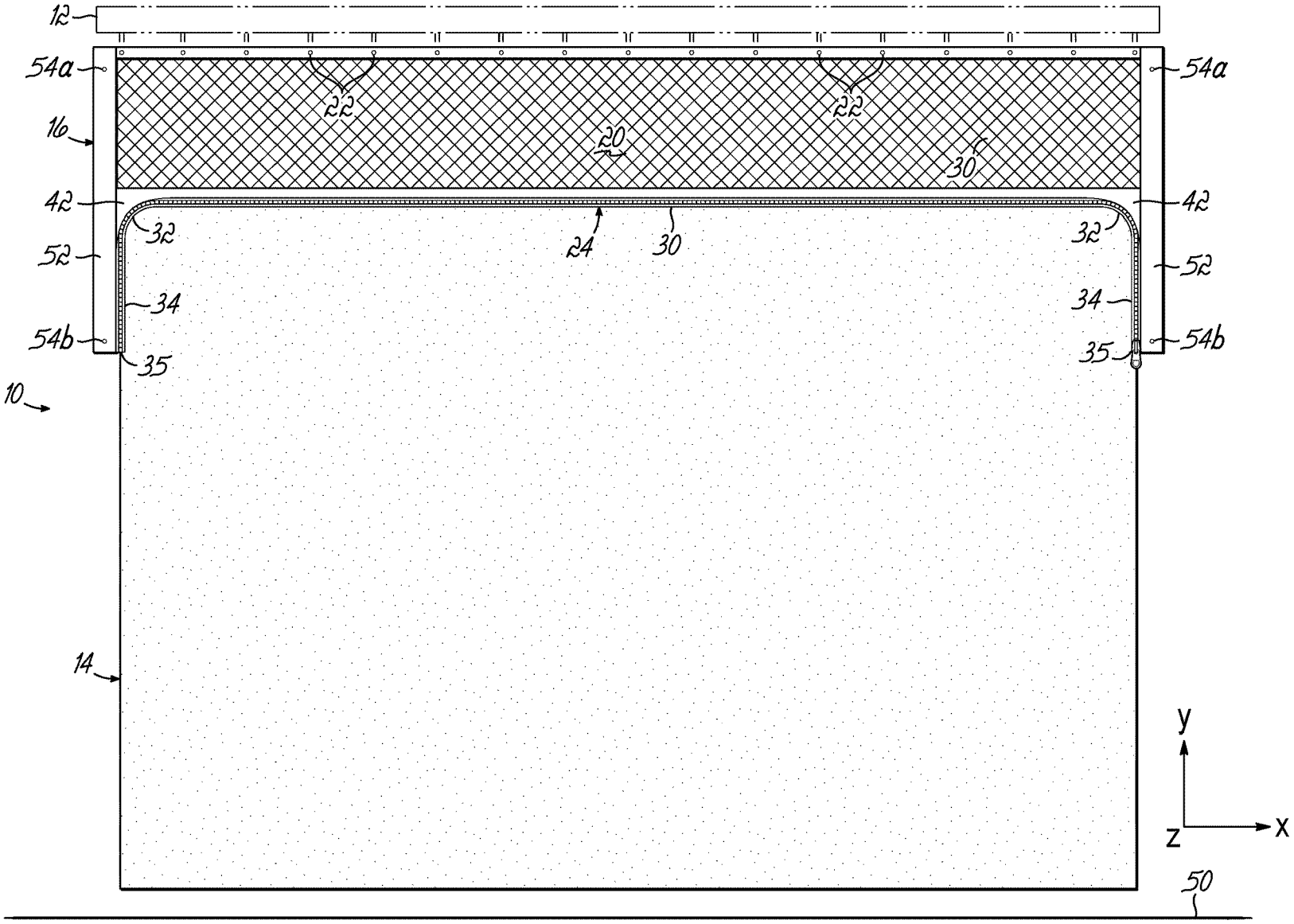
FIG. 2 is a front elevational view of the curtain of FIG. 1.

The top portion 16 may have a top segment made of a mesh material 20 for ventilation and is slideably attached along the ceiling track 12 using a number of curtain carriers coupled to spaced apart eyelets 22 on a top edge of the top portion 16. An attachment mechanism which in some embodiments is a zipper mechanism 24 extending between and selectively joining a top edge 14*a* of the bottom portion 14 to a bottom edge 16*a* of the narrow top portion 16 of the hospital curtain 10. The zipper mechanism 24 is shown in more detail in FIG. 2B and has upper and lower zipper tracks 24*a*, 24*b* with matingly interlocking teeth 26 that are separable for selectively removing/attaching the bottom portion 14 from/to the top portion 16 of the hospital curtain 10 when desired. The zipper 24 in various embodiments of this invention may have a central generally horizontal portion 30 with a generally linear path bounded on each end by an arcuate portion 32 having a radius of curvature. The zipper 24 may terminate proximate lateral ends of the curtain 10 at generally vertical portions 34 having a generally linear path as seen in FIGS. 1 and 2. Each generally vertical path portion 34 includes a terminus 35 of the zipper path.

Figure 2A:
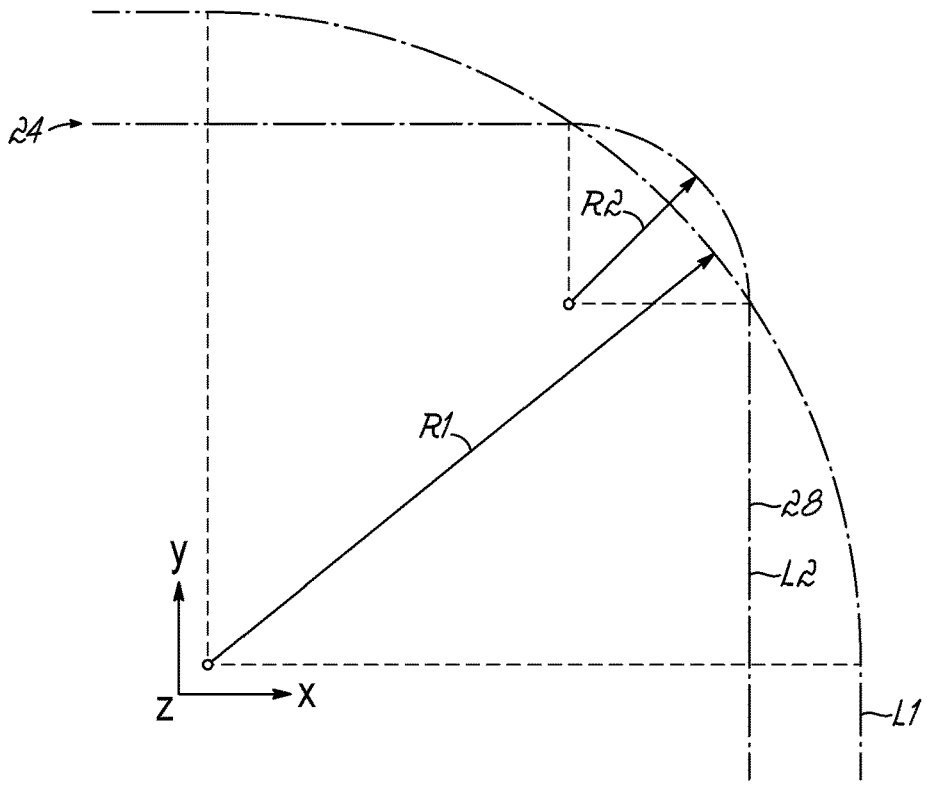
FIG. 2A is a schematic of multiple zipper paths.
Figure 3:
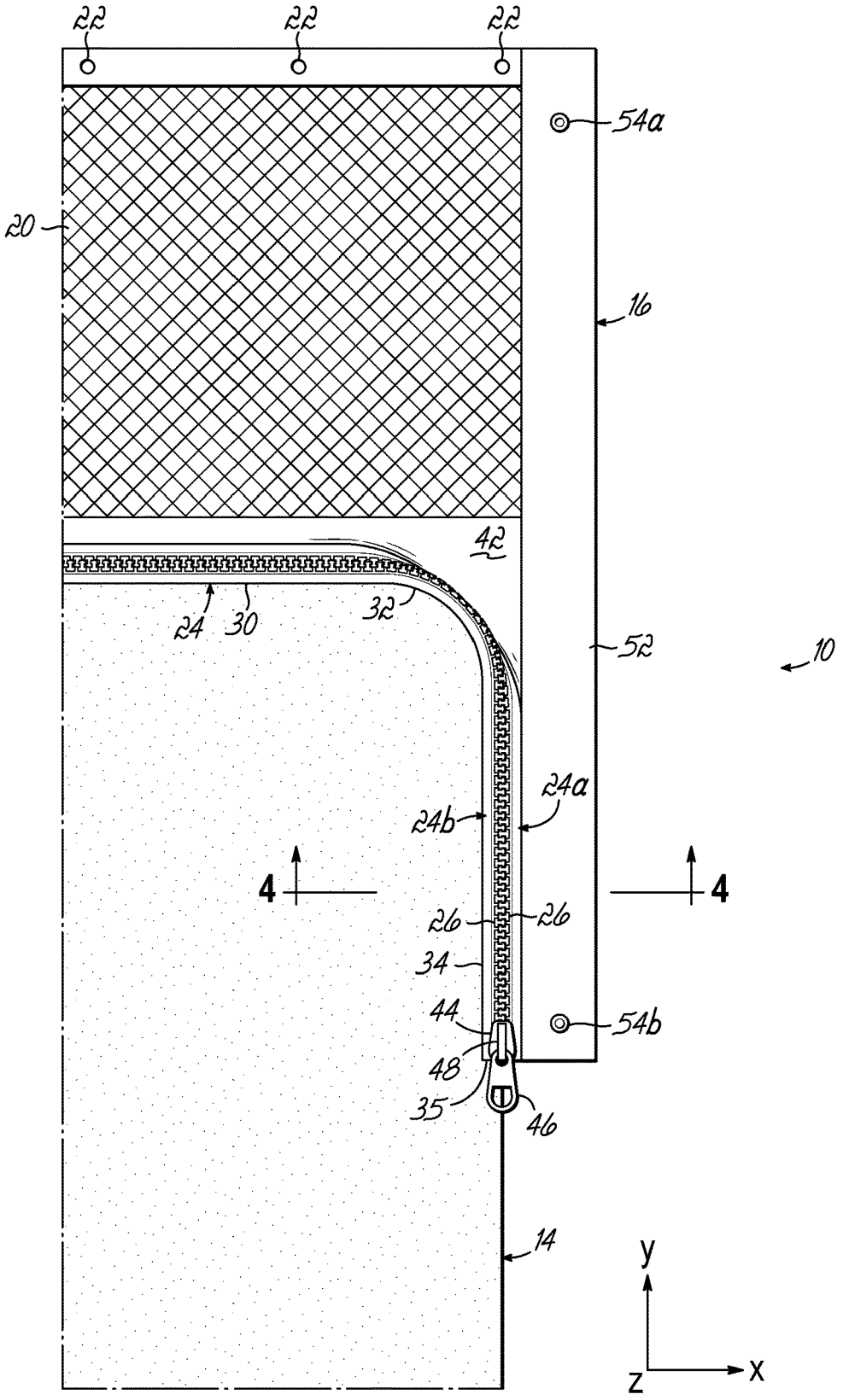
FIGS. 3 and 3A are an enlarged views of a portion of the curtain from FIGS. 1-2.
Figure 3A:
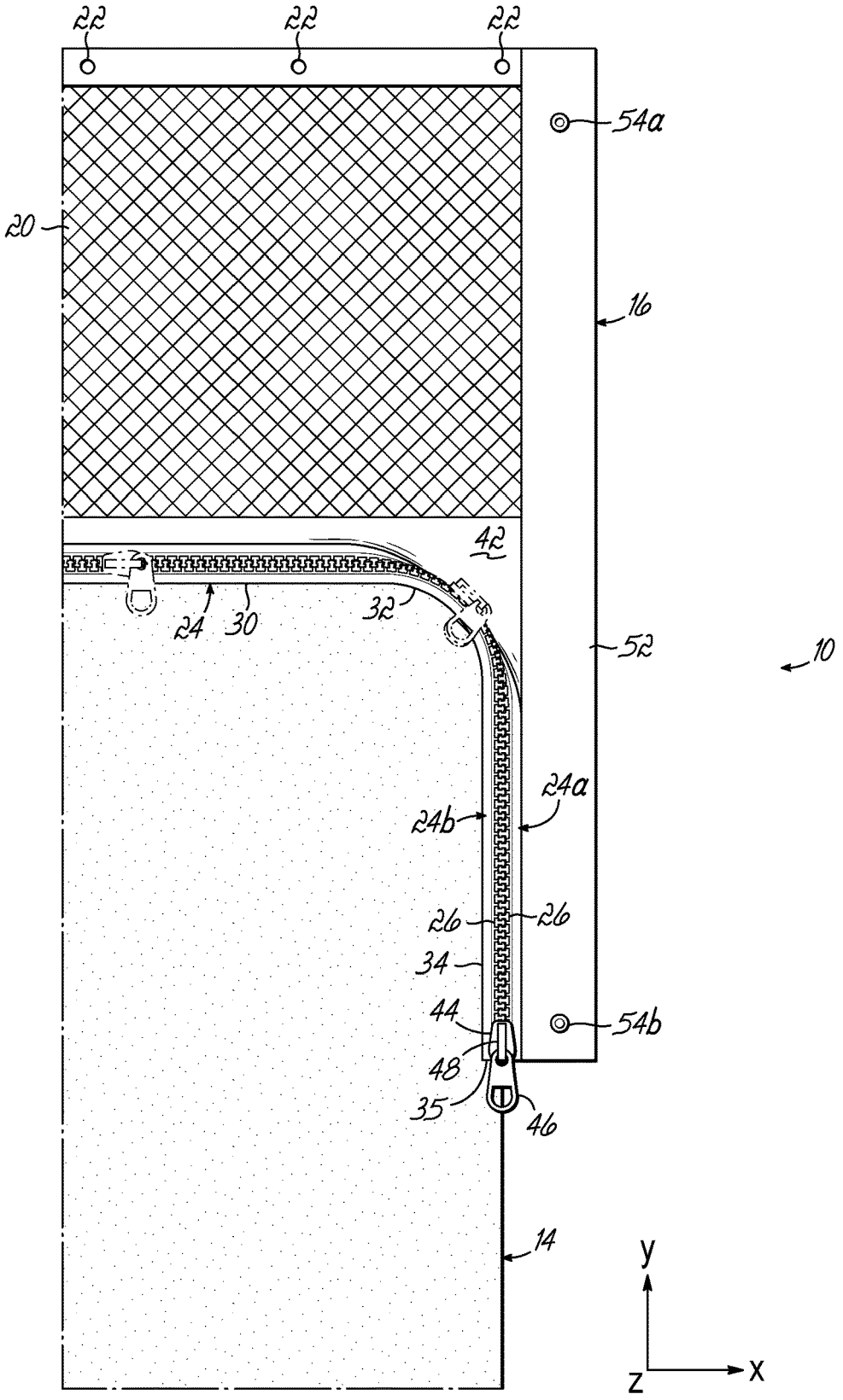

A schematic of a path of the zipper 24 according to this invention is shown in FIG. 2A. The schematic showing the zipper 24 of this invention depicts the path of the zipper 24 in a three dimensional plane (see also FIGS. 3-4). There are two lines shown in FIG. 2A, the first line L1 represents the zipper path 28 with a larger radius R1 arcuate portion 32 and the second line L2 shows a smaller radius R2 arcuate portion 32. The path L2 with the smaller radius R2 is more aesthetically pleasing for the curtain 10 and minimizes an intermediate triangular portion 42 (see FIG. 2), but may produce more stress on the zipper 24 being pulled around the arc R2 as previously described. Therefore, the orientation of the zipper 24 in the arc R2 is oriented to be out of the x-y plane of the curtain 10 to facilitate easier zipper 24 travel through the arcuate portion 32 (see FIGS. 3-3A). At the portion of the arc which is most pronounced, the two lines L1, L2 cross over, representing the area where the zipper 24 moves substantially ninety degrees, and changes from being located in the X-Y plane (essentially a two-dimensional plane), to extending out of the X-Y plane in a direction parallel to the Z-axis (essentially a three-dimensional plane), as shown in FIGS. 3 and 3A. The X-Y plane is also the plane in which the curtain 10 may fall if it is generally planar when suspended by the track 12.

Figure 2B:
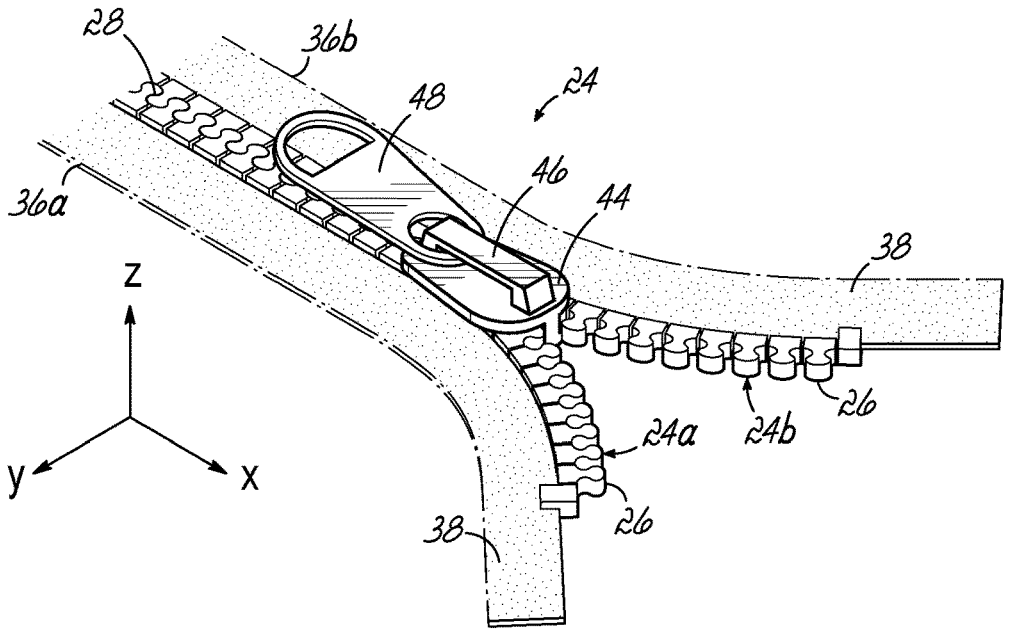
FIG. 2B is an enlarged perspective view of a zipper mechanism according to various embodiments of this invention.
Figure 4:
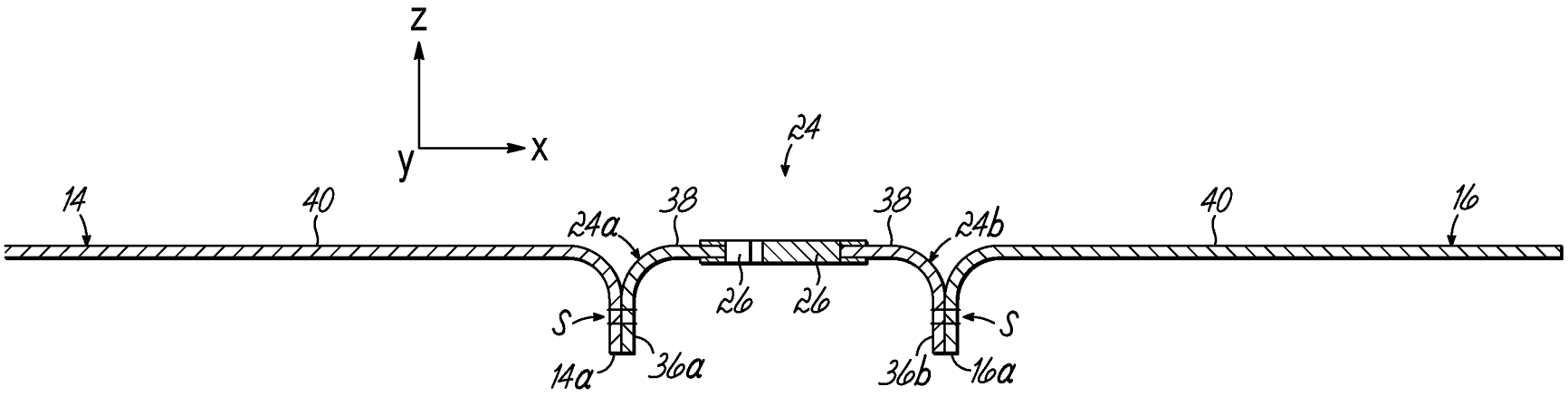
FIG. 4 is a cross-section view taken along line 4-4 of FIG. 3 of a joint between top and bottom portions of the curtain.

Referring to FIG. 2B, the teeth 26 of each of the zipper tracks 24*a*, 24*b*, are mounted to a tape 36*a*, 36*b*, respectively. Each tape 36*a*, 36*b* is sewn or otherwise attached to the bottom edge 16*a* of the top portion 16 and the top edge 14*a* of the bottom portion 14, respectively. As shown in FIG. 4, one aspect of various embodiments of this invention is the orientation in which the tapes 36*a*, 36*b* are attached to the respective edges 14*a*, 16*a*. Specifically, a top face 38 of each tape 36*a*, 36*b* is juxtaposed to the front, outer or top face 40 of the respective portion 14, 16 of the curtain 10 proximate the edge 14*a*, 16*a* of the portion 14, 16 of the curtain 10. In this orientation, each tape 36*a*, 36*b* is sewn S to the associated edge 14*a*, 16*a* of the adjacent portion 14, 16 of the curtain 10. With the joint 28 formed by the zipper 24 as shown in FIG. 4, the zipper 24 slides more easily through the arcuate portions 32 of its path. The joint arrangement shown in FIG. 4 allows the zipper 24 to transition from operation in one plane (i.e., the X-Y plane) in the linear portions 30, 34 of its path 28 to operation out of the one plane and to include operation in a plane not contained in or parallel to that one plane (i.e., Z-axis) thereby avoiding added stress on either track 24*a*, 24*b* and allowing for easier movement through the arcuate portions 32 of its path.

The zipper mechanism 24 follows the path 28 of the joint between the various sections 30, 32, 34 of the top and bottom portions 14, 16. In the embodiment of the top portion 16 show in FIG. 1, the top portion 16 extends downwardly at the lateral ends of the curtain 10. A generally triangular portion 42 extends superjacent to the arcuate portion 32 proximate to the bottom edge 16*a* of the top portion 16. The triangular portions 42 may be opaque, non-mesh or another material according to this invention.

According to various embodiments of this invention, the zipper mechanism 24 may include a slider hub 44 and a zipper pull tab 48 as seen in FIG. 2B. The zipper pull tab 32 may be secured to the slider hub 38 by a bridge 46. The slider hub 38 may be pulled along the zipper tracks 24*a*, 24*b* by a user engaging and pulling the zipper pull tab 48. The user may be standing on the floor 50 to reach the zipper mechanism 24 with our without a zipper assist pole to zip or unzip the zipper mechanism 24.

Figure 5:
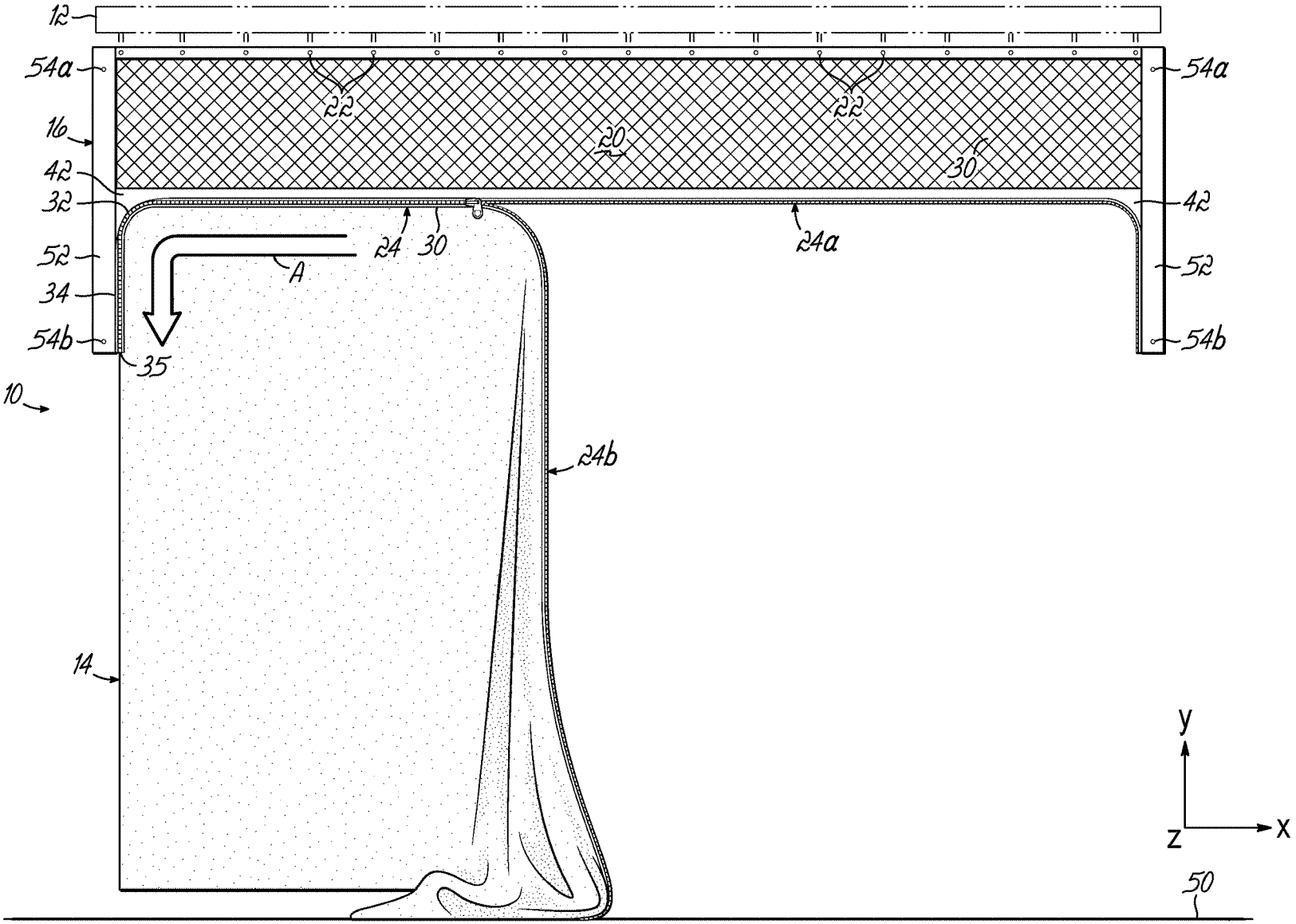
FIG. 5 is a front elevational view of the bottom portion of the curtain being detached from the top portion along a zipper mechanism according to one aspect of this invention.

FIG. 5 shows the bottom portion 14 starting to be detached from the top portion 16. The hospital curtain 10 of this invention includes the zipper mechanism 24. The zipper mechanism 24 provides a combined and engagement means that allows a user to attach or remove the bottom portion 14 to or from the top portion 16 when desired. In one embodiment, the interlocking teeth 26, are made of a polymer substance and may also be impregnated or infused with an antimicrobial compound similar to the bottom portion 14 of the hospital curtain 10. The zipper mechanism 24 may be separated by a user pulling the zipper pull tab 46 of the zipper mechanism 24 in the direction of arrow A in FIG. 5. Note also that it is contemplated that in the case of an emergency, if the curtain 10 needed to be removed more quickly, the interlocking zipper teeth 26, could be disengaged from one another by simply pulling downwardly, which would also cause the zipper tracks 24*a*, 24*b* to detach from one another.

When it is desired to attach or detach the bottom portion 14 to/from the top portion 16, the slider hub 44 of the zipper 24 is moved in a first direction or a second direction such that the tracks 24*a*, 24*b* of the zipper 24 are either connected or separated, depending upon whether the bottom portion 14 is being attached or detached. In either case, as the slider hub 44 is moved towards one of the curved portions 3*o*, both tracks 24*a*, 24*b* of the zipper 24 rotate about ninety-degrees and/or out of the X-Y plane, best shown in FIGS. 3-3A. The tracks 24*a*, 24*b* of the zipper 24 change from being located in the X-Y plane, to extending in a direction toward and/or parallel to the Z-axis, best shown in FIG. 3. Essentially, the tracks 24*a*, 24*b* may be perpendicular or non-parallel to the plane (i.e., the X-Y plane) of the top and bottom portions 16, 14 along the curved portions 32.

To facilitate the repositioning of the tracks 24*a*, 24*b* of the zipper 24, the tracks 24*a*, 24*b* of the zipper 24 are attached to the portions 14, 16 along the straight portions 3*o*, 34 stitched (see FIG. 4) such that the tracks 24*a*, 24*b* lay flat, in the X-Y plane, best shown in FIGS. 3-3A. The tracks 24*a*, 24*b* of the zipper 24 connected along the curved portions 32 are stitched such that they extend substantially along the Z-axis and/or out of the X-Y plane.

The zipper 24 having the cornering design of this invention facilitates the attachment and detachment of the bottom portion 16, without placing an imbalanced amount of stress on the zipper 24. While it has been described in this invention that the zipper 24 rotates to an angle of substantially ninety degrees, the rotation of the zipper 24 provides a reduction in stress on the zipper 24 when the zipper 24 is positioned in a range of generally about forty-five degrees to about one-hundred eighty degrees, typically from about sixty degrees to about one-hundred twenty degrees, and preferably about ninety degrees. Therefore, there is a benefit to the positioning of the zipper 24 at angles other than ninety degrees and/or out of the X-Y plane.

Figure 6:
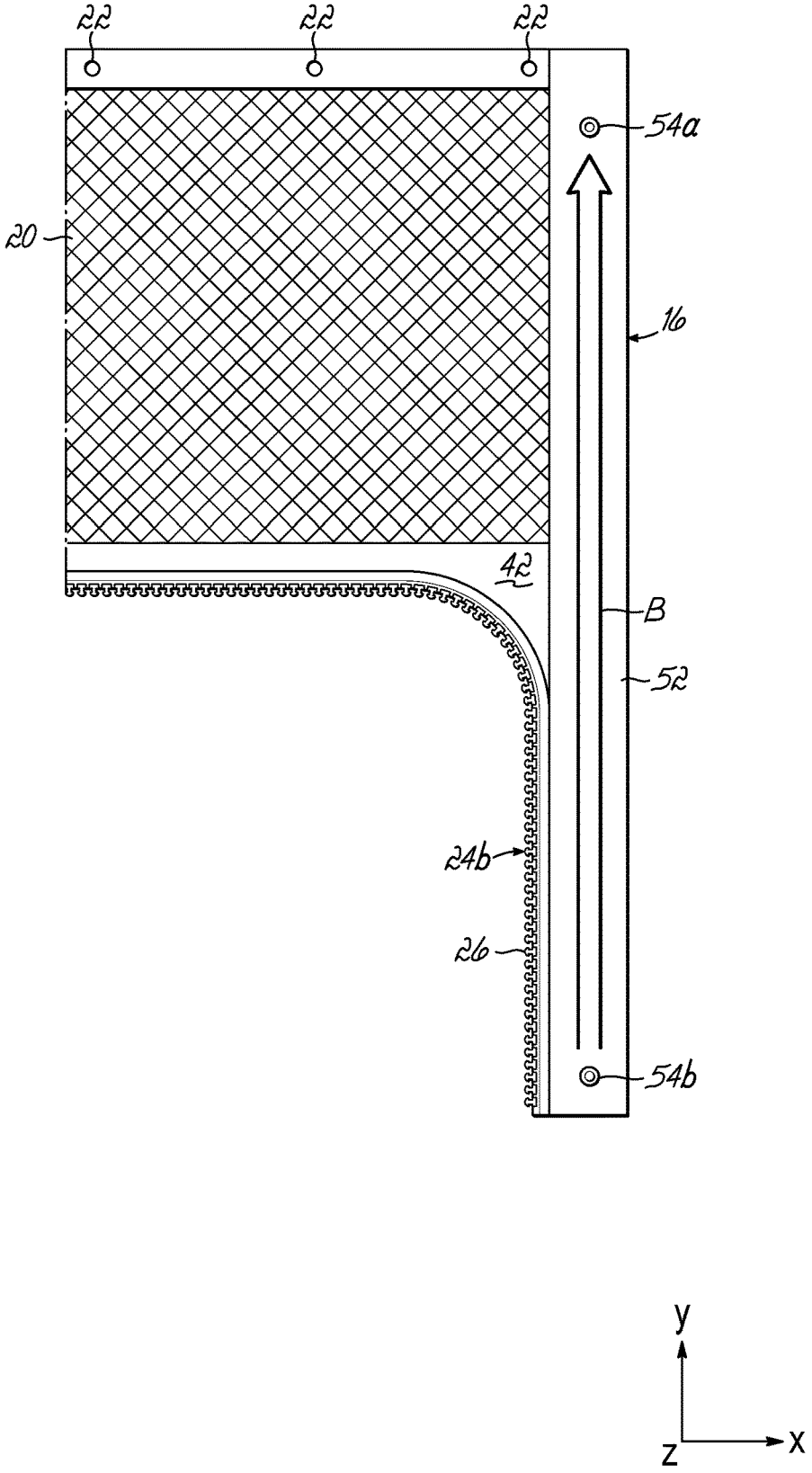
FIG. 6 is a view similar to FIG. 3 with the bottom portion of the curtain removed.
Figure 7:
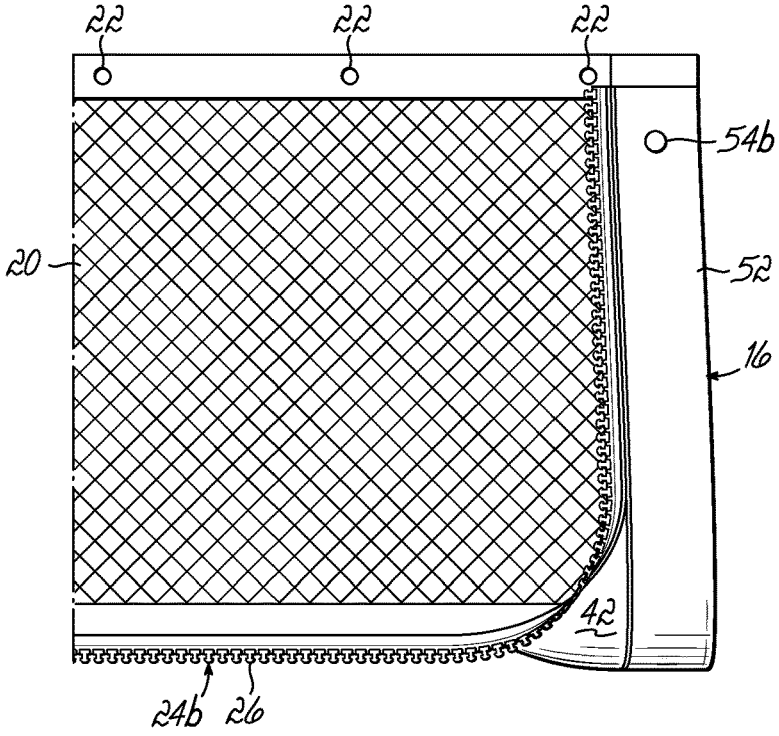
FIG. 7 is a view similar to FIG. 6 with a tail of the top portion secured in a compact configuration.
Figure 7:
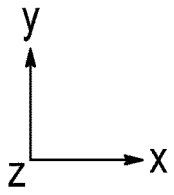

Another aspect of various embodiments of this invention is shown in FIGS. 6-7. Once the bottom portion 14 is removed from the curtain 10, a tail 52 remains hanging downwardly from the top portion 16. The tail 52 is adjacent to the vertical path 34 portion of the zipper path 28. An attachment mechanism 54 in the form of a pair of snaps 54*a*, 54*b* is included on the top portion 16 of various embodiments of this invention. The distal end of the tail 52 may be folded upwardly in the direction of arrow B in FIG. 6 to mate the snap 54*b* with the snap 54*a* and thereby secure the tail 52 to the remainder of the top portion 16. With the tail 52 secured as shown in FIG. 7, the tail 52 is not dangling in the exam area 18 for possible entanglement with personnel or equipment. Also, the secured tail 52 of FIG. 7 is more conducive to the washing and laundering of the top portion 16 as it will not become entangled with other items or twisted and damaged in the washing and drying machines.

These foregoing embodiments of the invention are exemplary only and in no manner should be viewed as exhaustive or limiting on the scope of this invention. Alternative numbers of components, method steps, materials, parameters, arrangements and other aspects may be utilized within the scope of this invention.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A curtain system comprising:

a curtain having a top portion and a bottom portion with a juncture therebetween, the curtain extending in a generally vertical orientation defining a first plane, and the curtain extending from a left lateral side edge to a right lateral side edge;

a first tail attached to a portion of the left lateral side edge associated with the top portion;

a second tail attached to a portion of the right lateral side edge associated with the top portion;

a first pair of snaps comprising a first snap associated with a first distal portion of the first tail and a first complementary snap associated with the top portion, wherein the first tail is configured to fold about itself such that the first pair of snaps is configured to temporality secure the first distal portion of the first tail to the top portion when the bottom portion is removed from the top portion;

a second pair of snaps comprising a second snap associated with a second distal portion of the second tail and a second complementary snap associated with the top portion, wherein the second tail is configured to fold about itself such that the second pair of snaps is configured to temporarily secure the second distal portion of the second tail to the top portion when the bottom portion is removed from the top portion; and a zipper selectively joining and separating the bottom portion to and from the top portion, the zipper extending in a path along the juncture between the top and bottom portions, and the bottom portion extending vertically from a bottom edge to the juncture; wherein the path sequentially comprises:

a first vertical path portion located proximate the left lateral side edge of the curtain and defining a first terminus of the path;

a first non-linear path portion;

a generally linear path portion;

a second non-linear path portion; and a second vertical path portion located proximate the right lateral side edge of the curtain and defining a second terminus of the path;

each of the first terminus of the path and the second terminus of the path is located vertically above the bottom edge of the bottom portion; and the zipper is configured to be oriented in the first plane when being operated in the generally linear path portion and in a second plane when being operated in one of the first and second non-linear path portions, the second plane being non-planar with the first plane.

2. The curtain system of claim 1 wherein each of the first and second non-linear path portions is arcuate.

3. The curtain system of claim 1 wherein the second plane is generally perpendicular to the first plane.

4. The curtain system of claim 1 wherein the generally linear path portion is generally horizontal.

5. The curtain system of claim 1 wherein the generally linear path portion is vertically higher than each of the first terminus and the second terminus.

6. The curtain system of claim 1 wherein the zipper is configured to transition from the first plane to a plurality of orientations, wherein an orientation of the plurality of orientations is planar with the second plane when moving from the generally linear path portion to one of the first and second non-linear path portions.

7. The curtain system of claim 6 wherein each of the plurality of orientations is non-parallel to the first plane.

8. The curtain system of claim 1 wherein the first tail is associated with the first vertical path portion; and the second tail is associated with the second vertical path portion.

9. The curtain system of claim 6 wherein the zipper further comprises:

a first and a second set of teeth wherein the first and second sets of teeth engage each other when the zipper joins the top and bottom portions together; and a first and a second tape to which the first and second sets of teeth are coupled, respectively;

wherein a first top face of the first tape and a second top face of the second tape are juxtaposed and attached to a top face of the top portion and a top face of the bottom portion, respectively, to facilitate the zipper moving to and between the first and second planes.

10. The curtain system of claim 1 further comprising:

a track from which the top portion of the curtain is suspended to guide movement of the curtain.

* * * * *